United States Patent [19]

Scott

[11] Patent Number: 4,522,521

[45] Date of Patent: Jun. 11, 1985

[54] PRINTER STAND INCLUDING STORAGE AREA FOR FANFOLD PAPER

[76] Inventor: Douglas Scott, 7081 Great Oaks Rd., Germantown, Tenn. 38138

[21] Appl. No.: 521,998

[22] Filed: Aug. 11, 1983

[51] Int. Cl.[3] ..... B41J 29/02

[52] U.S. Cl. ..... 400/691; 400/613.2; 312/208

[58] Field of Search ..... 400/613.2, 613.3, 613.4, 400/691; 312/21, 39, 40, 50, 91, 126, 235 R, 235 A, 183, 193, 208, 278, 279; 297/192, 196, 446, 447, 448, 454, 455, 456, 294, 310; 211/45, 47, 50, 51, 53, 55, 71, 72, 73, 85, 126, 193, 194, 49 R, 49 D, 198; 248/146, 678

[56] References Cited

U.S. PATENT DOCUMENTS

| | | | |
|---|---|---|---|
| 1,380,746 | 6/1921 | Smith | 400/613.2 X |
| 1,616,071 | 2/1927 | Waldheim | 400/613.4 X |
| 1,656,153 | 1/1928 | Smith | 312/40 |
| 1,974,948 | 9/1934 | Brown | 297/454 X |
| 2,219,762 | 10/1940 | Burdick et al. | 400/691 X |
| 2,300,984 | 11/1942 | Smith | 400/613.2 X |
| 2,325,039 | 7/1943 | Chesler | 312/50 |
| 2,656,098 | 10/1953 | Hutton | 248/678 X |
| 2,664,205 | 12/1953 | Shellman | 211/55 |
| 2,913,038 | 11/1959 | McDerby | 297/447 X |
| 3,028,975 | 4/1962 | Bullock | 211/126 |

OTHER PUBLICATIONS

IBM Technical Disclosure Bulletin, "Continuous Forms Holder/Guide", NEER, vol. 23, No. 3, Aug. 1980, p. 905.

IBM Technical Disclosure Bulletin, "Display Detachable Printer Stand", Gilvey et al., vol. 27, No. 1A, Jun. 1984, p. 39.

*Primary Examiner*—Ernest T. Wright, Jr.

*Attorney, Agent, or Firm*—Richard P. Crowley

[57] ABSTRACT

A printer stand for supporting a printer apparatus and for storing fanfold paper and which printer stand comprises an integral, plastic, generally U-shaped frame element, defining a storage space for fanfold paper within the frame for use by a printer apparatus placed on the top surface of the frame. The printer stand includes upright support elements within the storage area and toward the one open end of the frame element, which support elements are secured to only one surface of the top and bottom of the frame element. The printer stand also includes a paper-bar-retaining element on the lower upright bottom surface of the frame element to restrain the fanfold paper in the storage space, and to permit the free, upward movement of the fanfold paper from the storage area out the back open end of the frame to the printer apparatus on the printer stand.

14 Claims, 5 Drawing Figures

PRINTER STAND INCLUDING STORAGE AREA FOR FANFOLD PAPER

BACKGROUND OF THE INVENTION

There is a need and a requirement to provide a support surface or stand for modern-type printers, particularly those used in connection with data and word-processing computer devices, which printers employ and use substantial quantities of fanfold, continuous paper sheets for printing purposes. Typically, a printer stand provides a support surface adequate to support the printer, and also includes a storage area for the fanfold paper, so that the paper inserted in the printer may be fed continuously from the paper in the storage area. Generally, to assure free flow of the fanfold paper, the storage area is directly above or below the printer.

One printer stand includes a generally U-shaped frame element with support posts adhesively secured at each end to the upper and lower surfaces of the frame within the storage element and toward the back open end of the frame. While such support posts provide support, it has been found in practice that rough handling in shipment and use generally causes the breakage of the post elements or the post elements to become insecure. Further, in some stands, the ends of the U-shaped frame at the one end are generally in a vertical plane one edge above the other, while fanfold paper, placed within the storage area of the frame, tends to move outwardly in use and does not have fully free flow to the overhead supported printer.

It is, therefore, desirable to provide an integral printer stand to support a printer, and to provide a storage area beneath the supported printer for fanfold paper, which overcomes or avoids the disadvantages and difficulties associated with prior-art printer stands.

SUMMARY OF THE INVENTION

The invention relates to an improved printer-stand apparatus, and in particular concerns a simple, easily manufactured, low-cost, printer-stand apparatus which provides for the easy storage and free flow of fanfold paper from a storage area to an overhead printer on the printer stand.

The printer stand of the invention comprises a generally U-shaped, integrally molded or formed, plastic, generally and optionally transparent or translucent frame element. The upper and lower surface elements of the frame element are spaced apart and define a storage-space area therebetween, for the storage of a stack of flat, fanfold paper to be used in the printer. The upper end edge of the upper surface of the frame is shorter than the lower end edge, by an amount to permit the free and unimpeded, upward movement of the paper from the storage area. For example, it has been found that the upper edge should be spaced inwardly or be shorter by ½ or 1 inch, or typically up to about 2 inches, in order to permit the free movement of the paper upwardly to the printer. The length and width of the frame element and the resulting storage area are varied, to provide a proper support area for the printer and sufficient space for the size of the paper to be stored and used.

The frame element is generally and easily formed from a single, integral, thick, plastic sheet material, such as by employing a thermoplastic sheet material like an acrylic resin, and bending the material over and on a heated mandrel to the U-shaped form, although it is recognized that other methods of manufacture may be used. After formation, the edges of the frame are flame-polished, to remove sharp burrs or edges.

It has been found that the folded, stacked paper in the storage area tends to move outwardly, as it is being used by the printer, which movement may disrupt the free, upward flow of paper from the stack to the continuous sheet which fits into the printer. The frame element includes a restraining bar secured to the lower surface of the frame element, to prevent unwanted paper movement from the storage area. The restraining bar should extend generally a majority of the width of the back of the frame element and be of sufficient height to retain at least three, four or more of the lower sheets of the paper stack from movement. Typically, the bar element is of the same plastic as the frame element and is heat-sealed or adhesively or otherwise secured in place. It is important that the restraining bar be positioned so that it extends outwardly from the back upper end edges of the frame element, to permit the direct, generally vertical, upward movement of the paper from the storage area. The restraining bar should be positioned generally evenly with the back edges of the lower edge of the frame and extend inwardly generally about the distance that the lower end edge extends beyond the upper end edge of the frame. For example, the bar element may have a length of about 11 to 30 inches, a width of about ½ to 2 inches and a height of about ⅛ to ½ inch.

The printer stand of the invention also is characterized by a floating top surface, in that the frame element includes a post-type support, typically two, spaced-apart post elements, toward the open end of the frame element and within the storage area, to provide support to the top surface of the frame at the one end when the heavy printer is placed on the top upper surface. The post support elements are secured only to the top of the lower surface of the frame element and extend upwardly a distance somewhat slightly less than the height distance of the open area of the frame between the upper and lower surfaces of the storage area, when the printer stand is not in use, so that the upper surface is spaced apart from the post elements and floats when the frame is not in use. This structural arrangement avoids making the frame totally rigid, and yet the post supports provide full and adequate support when the printer is placed on the top of the upper surface, since the upper surface of the plastic frame is sufficiently resilient and movable, so that the weight of the printer presses the upper surface into contact with the top of the post support elements. Optionally, resilient or cushion elements, such as of felt, rubber, plastic or the like, may be used on the top of the post elements or on the opposite contacting surface of the frame, to insulate any vibration and noise from the printer and to cushion and prevent damage and scratches to the frame or post elements. Optionally also, such cushioning and insulating means can be used as feet for the frame element.

The post support elements may be of plastic and be transparent and secured the same as or differently from the restraining bar. Generally, the post elements are spaced apart to the width or slightly greater of the stack of fanfold paper to be used, so as to provide edge guidance and support to the paper stack in the storage area. For example, the post supports are preferably rectangular in shape, with the long length of the rectangle serving to retain and hold the paper stack in position in the storage area. The floating top of the printer stand, therefore, avoids post breakage in use and handling of a rigid foam frame, and yet in use provides support to the printer.

The printer stand of the invention provides in combination many advantages, while avoiding the difficulties of prior-art printers.

DESCRIPTION OF THE EMBODIMENTS

Figure 1:
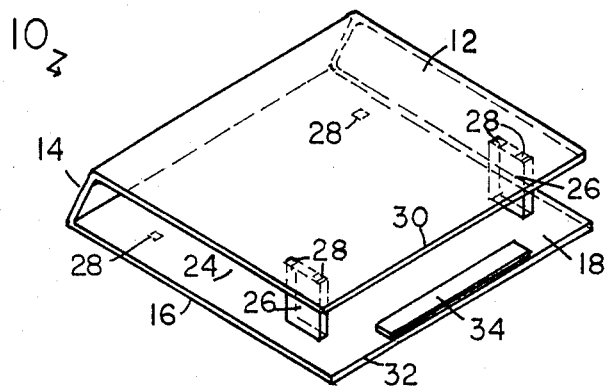
FIG. 1 is a perspective view from above of the printer stand of the invention.

The drawing shows a printer stand 10 thermo-formed of a bent, integral, ¼-inch sheet of smoked, translucent, acrylic resin sheet material in the general shape of a U, to form a frame having a sloped or rounded front sheet 14, a top sheet 12 and a bottom sheet 16. The frame has an open end 18, with the top and bottom sheets 12 and 16 forming a storage area 24 for a stack of fanfold paper 20, shown in FIG. 2, for feeding to a paper-receiving and-printing mechanism; for example, a daisy wheel, a typewriter print element or a printing-ink jet, of a printer 22 placed on the top sheet 12. The printer stand 10 includes a pair of rectangular, transparent, spaced-apart, plastic post support elements 26, with the narrow edge toward the back-front direction, and the posts 26 parallel to each other and spaced apart about or slightly over the width of the horizontal stack of fanfold paper 20 to be used with the printer 22. The posts 26 are secured to the upper surface of the bottom sheet 16, but not to the top sheet 12. The posts 26 have the top surface spaced slightly apart, for example, ⅛th to⅜ths of an inch, from the bottom surface of the top sheet 12, so as to provide a floating, unsecured, top sheet 12. The spaced-apart distance is such that, when the printer 22 is placed on the top sheet 12, the weight of the printer 22 causes the bottom surface of the top sheet 12 to rest on and be supported by the posts 26. As illustrated, the posts 26 optionally have elastomeric, insulating and cushioning buttons 28 thereon, while optionally, as illustrated, the bottom surface of the bottom sheet 16 also has such or similar buttons 28, to reduce noise and vibration and to prevent scratching or marring of the surface on which the printer 22 is placed.

Figure 2:
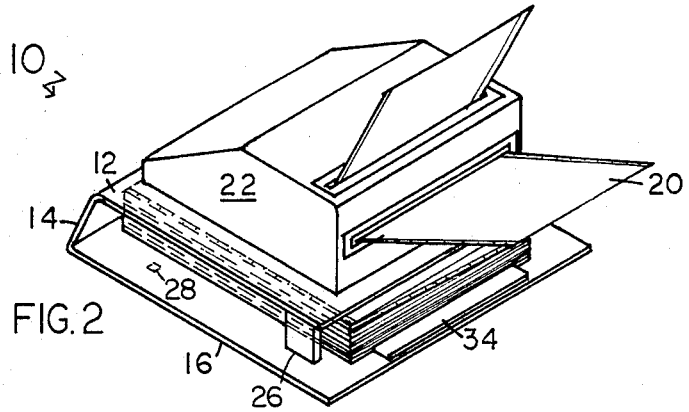
FIG. 2 is a perspective view from above of the printer stand of FIG. 1 with a printer thereon.
Figure 3:
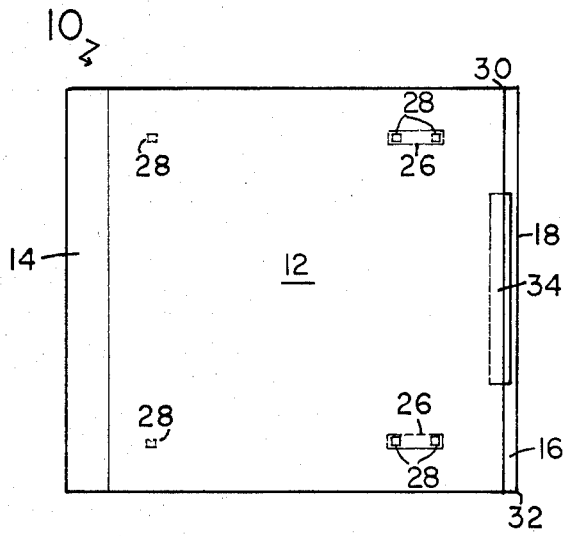
FIG. 3 is a top, elevation view of the printer stand of FIG. 1.
Figure 5:
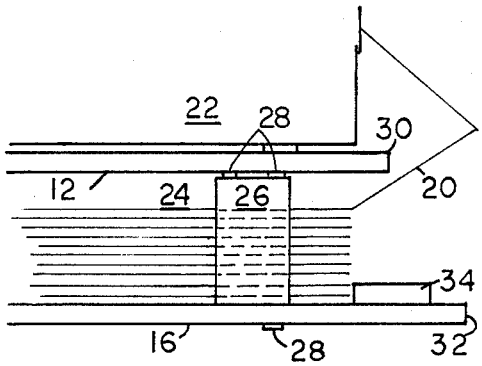
FIG. 5 is a fragmentary, enlarged, side view of a portion of FIG. 2.
Figure 4:
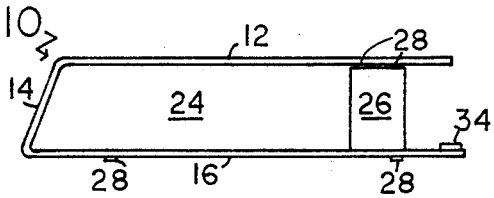
FIG. 4 is a side view of the printer stand of FIG. 1, the opposite side being the same.

The stand 10 also has the rounded, flame-polished, back edge 30 of the top sheet 12 spaced inwardly a defined distance, for example, 1 to 2 inches, from the flame-polished back edge 32 of the bottom sheet 16, so that the stack of fanfold paper 20 may move freely directly upwardly from the storage area 24, as shown in FIG. 2. A rectangular, raised, paper-restrainer bar 34 is secured to the lower edge surface and extends substantially across the width of the open end 18 of the frame and storage area 24, to aid in retaining the folded stack of paper 20 in position in the storage area 24. Generally, as illustrated more particularly in FIG. 5, the fold edges of the paper 20 are stacked against the inner edge of the restrainer bar 34, while the paper 20 is fed from the top surface of the paper stack, the inner edge of the bar 34 being generally aligned with the back edge 30 of the top sheet 12. The printer stand 10 of the invention can be employed and is useful with other fanfold paper-consuming devices and, as illusrated and described, overcomes many of the disadvantages of the prior-art stands.

What is claimed is:

1. A printer stand for supporting a printer apparatus and providing a storage area for fanfold paper used by the printer apparatus, which printer stand comprises:

(a) an integral frame element having a general U shape, said frame element having a top sheet element with a back edge and an upper surface on which said printer apparatus is placed, a front sheet element and a bottom sheet element having an upper surface and a back edge, and characterized by an open back end, to define a storage area between said sheet elements for the storage of a stack of fanfold paper used in the printer apparatus placed on the upper surface of the top sheet element, the back edge of the bottom sheet element extending outwardly a defined distance greater than the back edge of the top sheet element, to provide for the free, upward, generally vertical movement of said fanfold paper from the storage area to said printer apparatus;

(b) a paper-restraining means secured to the upper surface of the bottom sheet element and extending across at least a portion of the open back end and positioned generally below the back edge of the top sheet element and having sufficient height to retain said fanfold paper within the storage area, while the paper from the top of said fanfold stack is pulled upwardly in use by said printer apparatus; and (c) at least two support post means within the storage area and toward the open back end, to support the top sheet element, when the printer apparatus is placed on the upper surface of the top sheet element, said post means being secured to one of said top or bottom sheet element, said post means being spaced slightly apart from an opposite floating surface of the sheet element to which the post means is not secured, when the printer stand is not in use, said post means providing support to the top sheet element when said printer apparatus is placed on said upper surface of said top sheet element.

2. The printer stand of claim 1 wherein said frame element comprises a single, formed, thermoplastic, generally translucent, plastic sheet material.

3. The printer stand of claim 1 wherein said frame element comprises a single sheet of thermoformed, smoked-color, translucent, acrylic resin sheet material.

4. The printer stand of claim 1 wherein the paper-restraining means comprises a flat, generally rectangular bar element which extends across a substantial portion of the open back end of said frame element.

5. The printer stand of claim 4 wherein said bar element has a length of about 11 to 30 inches, a width of about ½ to 2 inches, and a height of about ⅛ to ½ inch.

6. The printer stand of claim 1 wherein the paper-restraining means comprises a bar element having a one and other edge, said one edge of which is generally aligned with the back edge of said bottom sheet element and the other edge extends inwardly at least the distance that said back edge of the said bottom sheet element extends beyond the back edge of said top sheet element.

7. The printer stand of claim 1 wherein the post means comprises a pair of spaced-apart post elements toward the open back end of said frame element and secured to the upper surface of said bottom sheet element, said post elements being spaced apart about at least the width of the said fanfold paper to provide edge guidance for said fanfold paper.

8. The printer stand of claim 7 wherein the post elements comprise a pair of generally narrow, rectangular post elements, the longer side of the post elements being spaced apart about the width of said fanfold paper to be stored therebetween and generally parallel to each other.

9. The printer stand of claim 7 wherein the post elements have a one top surface spaced apart from said top sheet element by about $\frac{1}{8}$ to $\frac{3}{8}$ of an inch.

10. The printer stand of claim 1 wherein the post means contains resilient means on the spaced apart free surface of said post means, to cushion and to insulate the printer apparatus in use when placed on said top sheet element.

11. The printer stand of claim 1 wherein the said back edge of said top sheet element is spaced up to about 2 inches from said back edge of said bottom sheet element.

12. A printer system which comprises in combination:

(a) a printer apparatus which employs fanfold paper from a stack of fanfold paper in usage;

(b) a stack source of fanfold paper for th printer apparatus; and (c) a printer stand which comprises:

(i) an integral frame element having a general U shape, said frame element having a top sheet element with a back edge and an upper surface on which said printer apparatus is placed, a front sheet element and a bottom sheet element with an upper surface and a back edge, and characterized by an open back end, to define a storage area between said sheet elements for the storage of said stack of fanfold paper used in said printer apparatus placed on the upper surface of the top sheet element, the back edge of the bottom sheet element extending outwardly a defined distance greater than the back edge of the top sheet element, to provide for the free, upward, generally vertical movement of said fanfold paper from the storage area to said printer apparatus;

(ii) a paper-restraining means secured to the upper surface of the bottom sheet element and extending across at least a portion of the open back end and positioned generally below the back edge of the top sheet element and having sufficient height to retain said fanfold paper within the storage area, while said paper from the top of said fanfold stack is pulled upwardly in use by said printer apparatus; and (iii) at least two support post means within the storage area and toward the open back end, to support the top sheet element, when said printer apparatus is placed on the upper surface of the top sheet element, said post means being secured to one of said top or bottom sheet element, said post means being spaced slightly apart from an opposite floating surface of the sheet element to which the post means is not secured, when said printer stand is not in use, said post means providing support to the top sheet element when said printer apparatus is placed on said upper surface of said top sheet element.

13. A printer stand for supporting a printer apparatus and providing a storage area for fanfold paper used by the printer apparatus, which printer stand comprises:

(a) an integral frame element having a general U shape and formed of a single sheet of rigid, thermoplastic sheet material, with a top sheet element with a back edge and having an upper surface on which said printer apparatus is placed, a front sheet element and a bottom sheet element with a back edge and having an upper surface, and characterized by an open back end, to define a storage area between said sheet elements for the storage of a stack of fanfold paper used in said printer apparatus placed on the upper surface of the top sheet element, the back edge of the bottom sheet element extending outwardly a defined distance greater than the back edge of the top sheet element, to provide for the free, upward, generally vertical movement of said fanfold paper from the storage area to said printer apparatus;

(b) a generally rectangular, paper-restraining bar means secured to the upper back surface of the bottom sheet element and extending across a substantial portion of the open back end and positioned generally below said back edge of the top sheet element and generally aligned with said back edge of said bottom sheet element, and having a height sufficient to retain the lower portion of the stack of fanfold paper in the storage area, while said fanfold paper is pulled continuously upwardly in use by the printer apparatus;

(c) support post means toward the open back end to support the top sheet element, when the printer apparatus is placed on the upper surface of the top sheet element, which post means comprises a pair of spaced-apart, generally narrow, rectangular post elements toward the open back end of said frame element, each post element being secured to said upper surface of said bottom sheet element and extending upwardly into a close, but noncontacting, relationship with said top sheet element, when the printer apparatus is not placed on the top sheet element, to provide a floating top sheet element, the post elements being spaced apart about the width of said fanfold paper stack to provide edge guidance to said paper; and (d) resilient means on the top surface of said post elements, to cushion the top sheet element in use and to reduce vibration, when said printer apparatus is in use.

14. A printer system which comprises in combination:

(a) a printer apparatus which employs fanfold paper from a stack of fanfold paper in usage;

(b) a stack source of fanfold paper for the printer apparatus; and (c) a printer stand which comprises:

(i) an integral frame element having a general U shape, said frame element having a top sheet element with a back edge and an upper surface on which said printer apparatus is placed, a front sheet element and a bottom sheet element with an upper surface and a back edge, and characterized by an open back end, to define a storage area between said sheet elements for the storage of said stack of fanfold paper used in said printer apparatus placed on the upper surface of the top sheet element, the back edge of the bottom sheet element extending outwardly a defined distance greater than the back edge of the top sheet element, to provide for the free, upward, generally vertical movement of said fanfold paper from the storage area to said printer apparatus;

(ii) a paper-restraining means secured to the upper surface of the bottom sheet element and extending across at least a portion of the open back end and positioned generally below the back edge of the top sheet element and having a sufficient height to retain said fanfold paper within the storage area, while said paper from the top of said fanfold stack is pulled upwardly in use by said printer apparatus; and (iii) at least two support post means within the storage area and toward the open back end, to support the top sheet element, when said printer apparatus is placed on the upper surface of the top sheet element, said post means being secured to one of said top or bottom sheet element, said post means being spaced slightly apart from an opposite floating surface of the sheet element to which the post means is not secured, when the printer stand is not in use, said post means providing support to the top sheet element when said printer apparatus is placed on said upper surface of said top sheet element.

* * * * *